US006790818B2

(12) United States Patent
Borgonjon et al.

(10) Patent No.: US 6,790,818 B2
(45) Date of Patent: Sep. 14, 2004

(54) HAND DISHWASHING COMPOSITION

(75) Inventors: Patrice Mark Luc Borgonjon, Mariakerke (BE); Baptiste Pommiers, Etterbeek (BE); Mark Robert Sivik, Mason, OH (US); Jean-Francois Bodet, Mason, OH (US)

(73) Assignee: Procter & Gamble Company, Cincinnati, OH (US)

( * ) Notice: Subject to any disclaimer, the term of this patent is extended or adjusted under 35 U.S.C. 154(b) by 55 days.

(21) Appl. No.: 10/102,125

(22) Filed: Mar. 20, 2002

(65) Prior Publication Data

US 2003/0064900 A1 Apr. 3, 2003

Related U.S. Application Data

(60) Provisional application No. 60/277,569, filed on Mar. 21, 2001.

(51) Int. Cl.[7] ..... C11D 1/722; C11D 3/20; C11D 3/37; C11D 3/43; B08B 3/04

(52) U.S. Cl. ..... 510/235; 510/238; 510/239; 510/240; 510/226; 510/362; 510/392; 510/413; 510/421; 510/475; 510/492; 510/499; 510/523; 134/25.2; 134/25.3; 134/38; 134/39; 134/40; 134/42

(58) Field of Search ..... 510/238–240, 510/226, 235, 362, 392, 413, 421, 475, 492, 499, 524; 134/25.2, 25.3, 38, 39, 40, 42

(56) References Cited

U.S. PATENT DOCUMENTS

| | | | | | |
|---|---|---|---|---|---|
| 6,498,134 | B1 | * | 12/2002 | Scheibel et al. | 510/357 |
| 6,506,717 | B1 | * | 1/2003 | Kott et al. | 510/357 |
| 6,521,577 | B1 | * | 2/2003 | Ofosu-Asante et al. | 510/237 |
| 2002/0132747 | A1 | * | 9/2002 | Huyhn et al. | 510/218 |
| 2003/0064900 | A1 | * | 4/2003 | Borgonjon et al. | 510/138 |

FOREIGN PATENT DOCUMENTS

| | | | | | |
|---|---|---|---|---|---|
| EP | 0 059 043 | A1 | | 9/1982 | |
| EP | 0 154 421 | A1 | | 9/1985 | |
| EP | 0 197 480 | A2 | | 10/1986 | |
| EP | 0 353 735 | A2 | | 2/1990 | |
| EP | 0 816 479 | A1 | | 1/1998 | |
| EP | 816479 | | * | 1/1998 | C11D/1/29 |
| EP | WO 00/43475 | | * | 7/2000 | |
| EP | WO 00/43477 | | * | 7/2000 | C11D/1/22 |
| EP | WO 00/46330 | | * | 8/2000 | C11D/3/30 |
| EP | WO 00/46331 | | * | 8/2000 | C11D/3/30 |
| EP | WO 01/10993 | | * | 2/2001 | C11D/3/20 |
| GB | 2 215 723 | A | | 9/1989 | |
| WO | WO 00/46330 | | | 8/2000 | |
| WO | WO 00/46331 | | | 8/2000 | |
| WO | WO 01/10993 | A1 | | 2/2001 | |

OTHER PUBLICATIONS

U.S. patent application Ser. No. 60/386,174, Bodet, filed Jun. 5, 2002.

* cited by examiner

*Primary Examiner*—Brian P. Mruk
(74) *Attorney, Agent, or Firm*—C. Brant Cook; Caroline Wei-Berk; Kim W. Zerby

(57) ABSTRACT

The present invention provide a composition suitable for use as a foaming hand dishwashing composition comprising a hydrophobic polymer having molecular weight of at least 500 and comprising butylene oxide moieties with the proviso that the composition does not comprise greater than 5% by weight of the composition of builder.

19 Claims, No Drawings

HAND DISHWASHING COMPOSITION

RELATED APPLICATIONS

This application claims priority under 35 U.S.C. §119(e) to U.S. Provisional Application Serial No. 60/277,569 filed Mar. 21, 2001.

TECHNICAL FIELD

The present invention relates to hand dishwashing composition designed and formulated to dissolve at a faster rate than previous composition of similar viscosity.

BACKGROUND

Liquid compositions are often designed to be used in diluted form. It is therefore necessary that the composition dissolves in water. In some cases, especially detergent compositions, the composition are thickened. Thickened compositions have several benefits, including: easier dispensing because they permit better control and accuracy of the dispensing process; improved dispersion of the composition over a surface; improved cling on non-horizontal surfaces. In addition to the technical reasons for using a thickened composition, consumers tend to equate composition thickness with richness and quality of cleaning performance.

Liquid compositions, especially thickened compositions can have the problem of poor mixing and dissolution in water. A composition that does not dissolve sufficiently quickly will give poorer cleaning and sudsing performance until the product has dissolved. This is not desirable, especially in the context of hand dishwashing where consumers rely on the appearance of suds to signal that the composition is active. In addition, poorly dissolving compositions do not rinse well from the hard surfaces such as dishware, especially glassware, leaving the surface feeling slippery or slimy. The consumer is therefore forced to use greater quantities of water to remove the residual composition from the surface.

Thickened hand dishwashing compositions are known in the prior art for example: Pril Gel sold by Henkel; Persil sold by Unilever; Palmolive Pots and Pans sold by Colgate and Palmolive, Power Max sold by Colgate and Palmolive. However these compositions dissolve more slowly and demonstrate the problems discussed above. It is an object of the present invention to provide a composition which dissolves in water at a faster rate that compositions described in the prior art having similar viscosity.

SUMMARY OF THE INVENTION

According to the present invention there is provided a composition suitable for use as a foaming hand dishwashing composition comprising a hydrophobic polymer having molecular weight of at least 500 and comprising alkylene oxide moieties, with the proviso that the composition does not comprise greater than 5% by weight of the composition of a builder.

DETAILED DESCRIPTION OF THE INVENTION

The compositions of the present invention may be suitable for use in cleaning hard surfaces such as dishware including dishes, cups, cutlery, glassware, food storage containers, cutlery, cooking utensils, sinks and other kitchen surfaces. Dishwashing compositions are designed so as to foam, since consumers have been found to use the signal of foam as an indicator that the composition is active and ready to be used.

The cleaning composition, may be in any suitable form for example gel, paste or liquid. The cleaning composition may be in liquid form. Moreover the cleaning composition may be in liquid aqueous form. Where present water can be present at a level of from 30 to 80% by weight of the cleaning composition and/or from 40 to 70% and/or from 45 to 65%. The composition may have any suitable pH. In another embodiment, the pH of the composition can be adjusted to between 4 and 14. In even another embodiment, the composition can have a pH of between 7 and 13, and/or between 7 and 10. The pH of the composition can be adjusted using pH modifying ingredients known in the art.

The composition of the present invention may be thickened and can have a viscosity of greater than 300 and/or greater than 500 cps when measured at 20° C. The present invention excludes compositions which are in the form of microemulsions.

Hydrophobic Polymer

The hydrophobic polymer of the present invention can be defined as a polymer having alkylene oxide moieties and an average molecular weight of at least 500 and/or at least 800. In one embodiment, the hydrophobic polymer has an average molecular weight of less than 10,000 and/or less than 5000 and/or less than 2000. In one embodiment, the hydrophobic polymer of the present invention can be defined as a polymer having alkylene oxide moieties and an average molecular weight of from 800 to 5000. In another embodiment, the hydrophobic polymer of the present invention can be defined as a polymer having alkylene oxide moieties and an average molecular weight of from 900 to 2000. In yet another embodiment, the hydrophobic polymer of the present invention can be defined as a polymer having alkylene oxide moieties and an average molecular weight of from 1000 to 1500. Nonlimiting examples of such hydrophobic polymers are polymeric glycols, which comprise alkylene oxide moieties, embodiments of which include, but are not limited to alkylene oxide moieties selected from ethylene oxide (EO), propylene oxide (PrO), butylene oxide (BO), pentylene oxide (PeO) and hexylene oxide (HO) moieties and mixtures thereof. However where ethylene oxide moieties are present they may be present in combination with another more hydrophobic moiety, for example propylene oxide or butylene oxide. In one embodiment, these hydrophobic polymers can be formed by adding blocks of alkylene oxide moieties to the ends of polypropylene glycol chains or other suitable alcohol. For example the polymer can be formed by reacting methanol with the alkylene oxide. In another embodiment, these hydrophobic polymers can be formed by reacting a mixture of alkylene oxide moieties with a suitable alcohol in a random fashion. Alternatively, these polymers can be made by polymerization of alkylene oxide groups, preferably PrO groups, or EO and PrO, or BO groups, with initiators that are commonly used for this reaction as known in the art.

In one embodiment, the polymeric glycol can be a polyproylene glycol. In one embodiment, the polypropylene glycol has an average molecular weight of at least 500 and/or from 500 to 10 000 and/or from 1000 and 5000 and/or from 1000 to 2500 and/or from 1500 to 2500. In another embodiment, the hydrophobic polymer can be a polybutylene glycol. In one embodiment, the polybutylene glycol has an average molecular weight of at least 500 and/or from 500 to 5000 and/or from 1000 to 4000 and/or from 1500 to 2500. In yet another embodiment, the hydrophobic polymer can be a polyhexylene glycol. In one embodiment, the polyhexylene glycol has an average molecular weight of at least 500 and/or from 800 to 5000 and/or from 1000 to 4000 and/or from 1500 to 2500.

The hydrophobic polymers of the present invention when incorporated into foaming liquid hand dishwashing compositions of the present invention prevent and/or reduce gelling and/or thickening of the liquid detergent compositions taught herein. Gelling has previously been observed in liquid detergent products prepared without the hydrophobic polymer as defined in the present invention, when the products are first contacted and diluted with water. Without being limited by theory, it is believed that this gelling phenomenon results from the surfactant system forming viscous surfactant phases (typically lamellar, spherulitic or hexagonal phases) at certain concentrations of surfactants and water. Alkylene oxide-containing compounds, especially butylenes oxide-containing compounds, have traditionally been used as non-foaming surfactants or suds suppressers. However the Applicants of the present invention have found that the polymers as described herein can be used in foaming hand dishwashing compositions to improve dissolution of the composition without significantly affecting the sudsing ability of the composition.

Without wishing to be bound by theory, it is believed that the hydrophobic polymers described above prevent the formation of the viscous surfactant phases formed upon dilution, because they can effectively interact with the ordered, structured layers of surfactant molecules, disrupt them and promote the formation of isotropic low-viscosity surfactant phases.

The hydrophobic polymers of the present invention may comprise on average at least 10% and/or at least 15% and/or at least 20% alkylene oxide moieties.

The hydrophobic polymer may be present in the composition at a level of from at least 0.05% and/or at least 0.1% and/or at least 0.2% by weight of the composition. The composition may also contain no more than 10% and/or no more than 8% and/or no more than 7% by weight of the composition of hydrophobic polymer.

Viscosity Test Method

The viscosity of the composition of the present invention is measured on a Brookfield viscometer model #LVDVII+ at 20° C. The spindle used for these measurements is S31 with the appropriate speed to measure products of different viscosities; e.g., 12 rpm to measure products of viscosity greater than 1000 cps; 30 rpm to measure products with viscosities between 500 cps–1000 cps; 60 rpm to measure products with viscosities less than 500 cps.

Speed of Solubility

An internationally recognised test method for measuring solubility of a composition in water does not exist. The Applicants have thus developed a solubility test which takes into account the starting viscosity of the composition, the viscosity of the composition on dilution and the speed of dissolution in an agitation test known as the cylinder dissolution test. By measuring the difference in viscosity of the composition as is and on dilution we can first understand whether the composition increases or decreases in viscosity on dilution. In the situation where viscosity of the product increases on dilution, it is believed that surfactants present in the composition form the viscous surfactant phase which results in the composition becoming more viscose. Solubility is inversely related to viscosity, thus the greater the viscosity, the slower the solubilisation of the composition in water. Where viscosity of a composition decreases by a small amount only on dilution, it is believed that some of the surfactants may still be forming a viscous surfactant phase and thus some surfactants create the thickening effect, whilst others do not. This situation results in a composition which still does not dissolve adequately well. However, a composition that significantly decreases in viscosity on dilution is a composition that can be expected to dissolve well in water. Hence by measuring the increase or decrease in viscosity in water, we can understand the extent of solubilisation of the composition in water.

The cylinder dissolution test demonstrates the solubility of the composition in water by directly measuring how much agitation is required for the composition to dissolve. Dissolution of the composition is achieved when it can no longer be seen in the cylinder.

For this test, 0.6 mL of product, dyed dark blue for visibility, is squirted into a cylinder containing 500 mL of water at 35° C. with a hardness of 15 g/gallon. The cylinder is then rotated through one full circle at 22 rpm. At the end of each successive rotation the cylinder is checked for remaining product. The cylinder is rotated until product is no longer visible. The number of rotations necessary for the product to have fully dissolved is noted. In a preferred embodiment of the present invention the compositions herein require no more than 8 rotations, more preferably no more than 7 rotations and most preferably no more than 5 rotations in order to dissolve fully.

Compositions were prepared according to the present invention and the initial viscosity (100% product), viscosity on dilution (80% product: 20% water and 60% product: 40% water) and solubility in water were measured. In addition the viscosity and solubility of hand dishwashing compositions currently sold on the market was also measured for comparison.

| | Viscosity (cps) | | | Cylinder Dissolution |
|---|---|---|---|---|
| Product | 100% product | 80% product | 60% product | (# rotations) |
| Composition A | 375 | 288 | 72 | 4 |
| Composition B | 384 | 123 | 17 | 3.4 |
| Composition C | 789 | 302 | 49 | 4.5 |
| Composition D | 1158 | 345 | 48 | 5 |
| Composition E | 334 | 217 | 58 | 4.5 |
| Henkel Pril Gel | 1927 | 6160 | 11020 | 26 |
| Palmolive Pots and Pans | 1000 | 779 | 660 | 31 |
| Palmolive Power Max | 593 | 448 | 399 | 16 |

-continued

| Product | Viscosity (cps) 100% product | 80% product | 60% product | Cylinder Dissolution (# rotations) |
|---|---|---|---|---|
| Unilever Persil | 964 | 1950 | 1237 | 10 |
| Pril | 630 | 1137 | 440 | 8 |
| Kao Family Power Gel | 500 | 700 | 1000 | 28 |

The following examples, whilst being representative of the compositions of the present invention are in no way meant to be limiting.

| | A | B | C | D | E |
|---|---|---|---|---|---|
| 1,4 CHDM | 1.5 | 3.0 | 3.0 | — | — |
| 1,6 Hexane Diol | — | — | — | 3.0 | — |
| PBG 2000[8] | 1.5 | 3.0 | 2.0 | 2.0 | 2.0 |
| PPG 2000[9] | 1.0 | — | — | — | — |
| Glycerol | — | — | — | 7.0 | — |
| Propylene Glycol | — | — | 6.5 | — | — |
| Ethanol | 6.0 | 4.15 | — | — | 7.8 |
| NaCl | 1.0 | 1.2 | 0.8 | 1.3 | 0.8 |
| SCS[7] | — | 2.0 | — | 2.0 | 2.0 |
| Amine Oxide[1] | 6.5 | 6.5 | 6.5 | 6.5 | 6.5 |
| Nonionic[2] | 3.0 | 3.0 | 3.0 | 3.0 | 3.0 |
| Anionic (AE0.6S)[3] | 27.0 | 27.0 | 27.0 | 27.0 | 27.0 |
| 1,3 BAC[4] | 0.5 | 0.5 | 0.5 | 0.5 | 0.5 |
| Suds boosting polymer[5] | 0.2 | 0.2 | 0.2 | 0.2 | 0.2 |
| protease[6] | | | | | |
| water to balance | | | | | |
| pH @ 10% | 9 | 9 | 9 | 9 | 9.5 |

[1]$C_{12}$–$C_{14}$ Amine oxide.
[2]Nonionic may be either C11 Alkyl ethoxylated surfactant containing 9 ethoxy groups or or C10 Alkyl ethoxylated surfactant containing 8 ethoxy groups.
[3]C12–13 alkyl ethoxy sulfonate containing an average of 0.6 ethoxy groups.
[4]1,3, BAC is 1,3 bis(methylamine)-cyclohexane.
[5](N,N-dimethylamino)ethyl methacrylate homopolymer
[6]The protease is selected from: Savinase ®; Maxatase ®; Maxacal ®; Maxapem 15 ®; subtilisin BPN and BPN'; Protease B; Protease A; Protease D; Primase ®; Durazym ®; Opticlean ®; and Optimase ®; and Alcalase ®.
[7]Sodium Cumene Sulphonate
[8]polybutylene glycol, molecular weight 2000
[9]polypropylene glycol, molecular weight 2000

Builder

The compositions according to the present invention may further comprise a builder, on the proviso that they do not comprise greater than 5% builder. If it is desirable to use a builder, then any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylene-phosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH)$CH_2$(COOH) wherein R is $C_{10-20}$ alkyl or alkenyl, preferably $C_{12-16}$, or wherein R can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

If detergency builder salts are included, they will be included in amounts of from up to 5% by weight of the composition, preferably from 0.01% to 4% and most usually from 0.05% to 4% by weight.

Optional Ingredients

The compositions of the present invention may also comprise optional ingredients for example solvatrope, hydrotrope, viscosity modifier, diamine, surfactants, polymeric suds stabiliser, enzymes, builder, perfume, chelating agent and mixtures thereof.

All parts, percentages and ratios used herein are expressed as percent weight unless otherwise specified. All documents cited are, in relevant part, incorporated herein by reference.

Solvatrope

A solvatrope is an optional, but preferred ingredient of the compositions of the present invention. Solvatrope refers to a solvent that also exhibits behavior like that of a hydrotrope. The solvatrope increases the solubility or the degree of miscibility between the various surfactant phases present in the formulation. Solvatropes act as coupling agents between the surfactant system and water and prevent the formation of viscous phases.

Solvatrope as used herein is defined as a component having two polar groups separated from each other by at least 4, preferably at least 6 aliphatic carbon atoms. Examples of suitable polar groups for inclusion in the solvatrope include hydroxyl and carboxyl groups, most preferably hydroxyl groups. Particularly preferred solvatropes are selected from the group consisting of:

11,4 Cyclo Hexane Di Methanol:

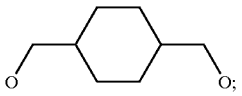

1,6 Hexanediol:

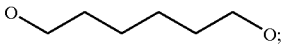

-continued and 1,7 Heptanediol:

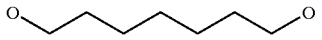

and mixtures thereof.

Mixtures of these organic molecules or any number of solvatropes are also acceptable. 1,4 Cyclo Hexane Di Methanol may be present in either its cis configuration, its trans configuration or a mixture of both configurations.

Hydrotrope

The compositions of the present invention may preferably comprise a hydrotrope. Hydrotrope generally means a compound with the ability to increase the solubilities, preferably aqueous solubilities, of certain slightly soluble organic compounds, more preferably "hydrotrope" is defined as follows (see S. E. Friberg and M. Chiu, J. Dispersion Science and Technology, 9(5&6), pages 443 to 457, (1988–1989)):

1. A solution is prepared comprising 25% by weight of the specific compound and 75% by weight of water.
2. Octanoic Acid is thereafter added to the solution in a proportion of 1.6 times the weight of the specific compound in solution, the solution being at a temperature of 20° C. The solution is mixed in a Sotax beaker with a stirrer with a marine propeller, the propeller being situated at about 5 mm above the bottom of the beaker, the mixer being set at a rotation speed of 200 rounds per minute.
3. The specific compound is hydrotrope if the the Octanoic Acid is completely solubilised, i.e. if the solution comprises only one phase, the phase being a liquid phase.

Preferred hydrotopes include the alkyl aryl sulphonates or alkyl aryl sulphonic acids. Preferred alkyl aryl sulphonates include: sodium, potassium, calcium and ammonium xylene sulphonates; sodium, potassium, calcium and ammonium toluene sulphonates; sodium, potassium, calcium and ammonium cumene sulphonates; sodium, potassium, calcium and ammonium substituted or unsubstituted naphthalene sulphonates; and mixtures thereof. Preferred alkyl aryl sulphonic acids include xylene sulphonic acid, toluene sulphonic acid, cumene sulphonic acid, substituted or unsubstituted naphthalene sulphonic acid and mixtures thereof. More preferably, cumene sulphonate or p-toluene sulphonate or mixtures thereof are used.

Viscosity Modifier

The present compositions may preferably comprise a viscosity modifier. Suitable viscosity modifiers include lower alkanols, ethylene glycol, propylene glycol, ethers, amines, and the like may be used in the present invention. Particularly preferred are the C1–C4 alkanols.

Suitable viscosity modifiers for use herein include ethers and diethers having from 4 to 14 carbon atoms, preferably from 6 to 12 carbon atoms, and more preferably from 8 to 10 carbon atoms. Also other suitable viscosity modifiers are glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable alkoxylated alcohols which can be used herein are according to the formula $$R—(A)_n—R^1—OH$$

wherein R is H, a linear saturated or unsaturated alkyl of from 1 to 20 carbon atoms, preferably from 2 to 15 and more preferably from 2 to 10, wherein $R^1$ is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated alcohols to be used herein are methoxy octadecanol and/or ethoxyethoxyethanol.

Suitable aromatic alcohols which can be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols which can be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula R (A)n-OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable linear C1–C5 alcohols which can be used herein are according to the formula R—OH wherein R is a linear saturated or unsaturated alkyl group of from 1 to 5 carbon atoms, preferably from 2 to 4. Suitable linear $C_1$–$C_5$ alcohols are methanol, ethanol, propanol or mixtures thereof.

Other suitable viscosity modifiers include, but are not limited to, butyl diglycol ether (BDGE), butyltriglycol ether, ter amilic alcohol and glycerol. Particularly preferred viscosity modifiers which can be used herein are butoxy propoxy propanol, butyl diglycol ether, benzyl alcohol, butoxypropanol, propylene glycol, glycerol, ethanol, methanol, isopropanol and mixtures thereof.

Other suitable viscocity modifies for use herein include propylene glycol derivatives such as butoxyproponal or n-butoxy propoxy propanol, water soluble CARBITOL® R viscocity modifies or water-soluble CELLOSOLVE® viscosity modifiers; water-soluble CARBITOL® viscosity modifiers are compounds of the 2-(2-alkoxyethoxy)ethanol class wherein she alkoxy group is derived from ethyl, propyl or butyl; a preferred water-soluble CARBITOL® is 2-(2-butoxyethoxy)ethanol also known as BUTYL CARBITOL®. Water-soluble CELLOSOLVE® viscosity modifiers are compounds of the 2-alkoxyethoxy ethanol class, with 2-butoxyethoxyethanol being preferred. Other suitable viscosity modifiers include benzyl alcohol, and diols such as 2-ethyl-1,3-hexanediol and 2,2,4-trimethyl-1,3-pentanediol and mixtures thereof. Some preferred viscosity modifiers for use herein are n-butoxypropoxypropanol. BUTYL CARBITOL® and mixtures thereof.

The viscosity modifiers can also be selected from the group of compounds comprising ether derivatives of mono-, di- and tn-ethylene glycol, bucylene glycol ethers, and mixtures thereof. The molecular weights of these viscosity modifiers are preferably less than 350, more preferably between 100 kind 300, even more preferably between 115 and 250. Examples of preferred viscosity modifiers include, for example, mono-ethylene glycol n-hexyl ether, mono-propylene glycol n-butyl ether, and tri-propylene glycol methyl ether. Ethylene glycol and propylene glycol ethers are commercially available from the Dow Chemical Company under the tradename "DOWANOL®" and from the Arco Chemical Company under the tradename "ARCO-SOLV®". Other preferred viscosity modifiers including mono- and di-ethylene glycol n-hexyl ether are available from the Union Carbide Company.

When present the composition will preferably contain at least 0.01%, more preferably at least 0.5%, even more preferably still, at least 1% by weight of the composition of viscosity modifier. The composition will also preferably contain no more than 20%, more preferably no more than 10%.

These viscosity modifiers may be used in conjunction with an aqueous liquid carrier, such as water, or they may be used without any aqueous liquid carrier being present. Viscosity modifiers are broadly defined as compounds that are liquid at temperatures of 20° C.–25° C. and which are not considered to be surfactants. One of the distinguishing features is that viscosity modifiers tend to exist as discrete entities rather than as broad mixtures of compounds. Examples of suitable viscosity modifiers for the present invention include ethanol, propanol, isopropanol, 2-methyl pyrrolidinone, benzyl alcohol and morpholine n-oxide. Preferred among these viscosity modifiers are ethanol and isopropanol.

Diamines

Another optional although preferred ingredient of the compositions according to the present invention is a diamine. In the context of a hand dishwashing composition, the "usage levels" of such diamine in the compositions herein can vary depending not only on the type and severity of the soils and stains, but also on the wash water temperature, the volume of wash water and the length of time the hard surface (i.e., dishware) is contacted with the wash water.

Since the habits and practices of the users of detergent compositions show considerable variation, the composition will preferably contain at least 0.1%, more preferably at least 0.2%, even more preferably, at least 0.25%, even more preferably still, at least 0.5% by weight of said composition of diamine. The composition will also preferably contain no more than 15%, more preferably no more than 10%, even more preferably, no more than 6%, even more preferably, no more than 5%, even more preferably still, no more than about 1.5% by weight of said composition of diamine.

It is preferred that the diamines used in the present invention are substantially free from impurities. That is, by "substantially free" it is meant that the diamines are over 95% pure, i.e., preferably 97%, more preferably 99%, still more preferably 99.5%, free of impurities. Examples of impurities which may be present in commercially supplied diamines include 2-Methyl-1,3-diaminobutane and alkylhydropyrimidine. Further, it is believed that the diamines should be free of oxidation reactants to avoid diamine degradation and ammonia formation.

Preferred organic diamines are those in which pK1 and pK2 are in the range of 8.0 to 11.5, preferably in the range of 8.4 to 11, even more preferably from 8.6 to 10.75. Preferred materials for performance and supply considerations are 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, NY, 1990.

It has been determined that substituents and structural modifications that lower pK1 and pK2 to below 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

The diamines useful herein can be defined by the following structure:

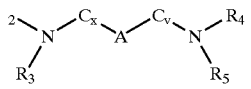

wherein $R_{2-5}$ are independently selected from H, methyl, —$CH_3CH_2$, and ethylene oxides; $C_x$ and $C_y$ are independently selected from methylene groups or branched alkyl groups where x+y is from 3 to 6; and A is optionally present and is selected from electron donating or withdrawing moieties chosen to adjust the diamine pKa's to the desired range. If A is present, then x and y must both be 1 or greater.

Examples of preferred diamines can be found in the copending provisional patent application of Phillip Kyle Vinson et al., entitled "Dishwashing Detergent Compositions Containing Organic Diamines for Improved Grease Cleaning, Sudsing, Low Temperature Stability and Dissolution", having P & G Case No. 7167P, application serial No. 60/087,693, and filed on Jun. 2, 1998, which is hereby incorporated by reference.

Carboxylic Acid

The compositions according to the present invention may comprise a linear or cyclic carboxylic acid or salt thereof. Where the acid or salt thereof is present and is linear, it preferably comprises from 1 to 6 carbon atoms whereas where the acid is cyclic, it preferably comprises greater than 3 carbon atoms. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms and mixtures thereof The carboxylic acids or salts thereof preferably have a pKa1 of less than 7, more preferably from 1 to 3. The carboxylic acid and salts thereof may comprise one or two or more carboxylic groups.

Suitable carboxylic acids or salts thereof are those having the general formula:

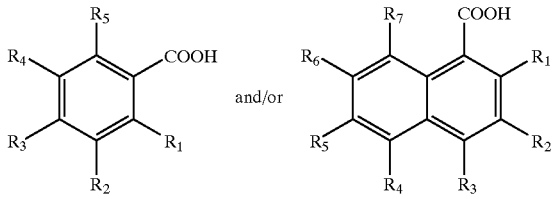

wherein $R_1$, $R_2$, $R_3$, $R_4$, $R_5$, $R_6$, $R_7$ are selected from the group consisting of alkyl chain having from 1 to 3 carbon atoms, hydroxy group, hydrogen, ester group, carboxylic acid group with the proviso that no more than 3 carboxylic acid groups are present.

Preferred carboxylic acids are those selected from the group consisting of salicylic acid, maleic acid, acetyl salicylic acid, 3 methyl salicylic acid, 4 hydroxy isophthalic acid, dihydroxyfumaric acid, 1,2,4 benzene tricarboxylic acid, pentanoic acid and salts thereof and mixtures thereof. Where the carboxylic acid exists in the salt form, the cation of the salt is preferably selected from alkali metal, alkaline earth metal, monoethanolamine, diethanolamine or triethanolamine and mixtures thereof.

The carboxylic acid or salt thereof is preferably present at the level of from 0.1% to 5%, more preferably from 0.2% to 1% and most preferably from 0.25% to 0.5%.

Carboxylic acids can be used to provide improved rinse feel as defined below. The presence of anionic surfactants, especially when present in higher amounts in the region of 15–35% by weight of the composition, results in the composition imparting a slippery feel to the hands of the user and the hard surface (i.e., dishware). This feeling of slipperiness is reduced when using the carboxylic acids as defined herein i.e. the rinse feel becomes draggy.

Surfactant

The compositions of the present invention preferably comprise a surfactant. Surfactants may be selected from the group consisting of amphoteric, zwitterionic, nonionic, anionic, cationic surfactants and mixtures thereof.

Amphoteric surfactants are preferred additional surfactants. The amphoteric surfactants useful in the present invention are preferably selected from amine oxide surfactants. Amine oxides are semi-polar nonionic surfactants and include water-soluble amine oxides containing one alkyl moiety of from 10 to 18 carbon atoms and 2 moieties selected from the group consisting of alkyl groups and hydroxyalkyl groups containing from 1 to 3 carbon atoms; water-soluble phosphine oxides containing one alkyl moiety of from 10 to 18 carbon atoms and 2 moieties selected from the group consisting of alkyl groups and hydroxyalkyl groups containing from 1 to 3 carbon atoms; and water-soluble sulfoxides containing one alkyl moiety of from 10 to 18 carbon atoms and a moiety selected from the group consisting of alkyl and hydroxyalkyl moieties of from 1 to 3 carbon atoms.

Semi-polar nonionic detergent surfactants include the amine oxide surfactants having the formula

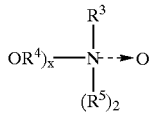

wherein $R^3$ is an alkyl, hydroxyalkyl, or alkyl phenyl group or mixtures thereof containing from 8 to 22 carbon atoms; $R^4$ is an alkylene or hydroxyalkylene group containing from 2 to 3 carbon atoms or mixtures thereof; x is from 0 to 3; and each $R^5$ is an alkyl or hydroxyalkyl group containing from 1 to 3 carbon atoms or a polyethylene oxide group containing from 1 to 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Also suitable are amine oxides such as propyl amine oxides, represented by the formula:

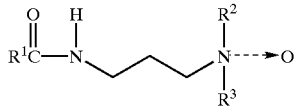

wherein $R_1$ is an alkyl 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl and n is from 0 to 10.

A further suitable species of amine oxide semi-polar surface active agents comprise compounds and mixtures of compounds having the formula:

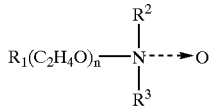

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl and n is from 0 to 10. Particularly preferred are amine oxides of the formula:

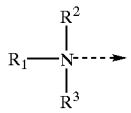

wherein $R_1$ is a $C_{10-14}$ alkyl and $R_2$ and $R_3$ are methyl or ethyl. Because they are low-foaming it may also be desirable to use long chain amine oxide surfactants which are more fully described in U.S. Pat. No. 4,316,824 (Pancheri), U.S. Pat. No. 5,075,501 and 5,071,594, incorporated herein by reference.

Other suitable, non-limiting examples of amphoteric detergent surfactants that are useful in the present invention include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group.

Further examples of suitable amphoteric surfactants are given in "Surface Active Agents and Detergents" (Vol. I and II by Schwartz, Perry and Berch), hereby incorporated by reference.

Preferably the amphoteric surfactant where present, is present in the composition in an effective amount, more preferably from 0.1% to 20%, even more preferably 0.1% to 15%, even more preferably still from 0.5% to 10%, by weight.

Suitable nonionic detergent surfactants are generally disclosed in U.S. Pat. No. 3,929,678, Laughlin et al., issued Dec. 30, 1975, at column 13, line 14 through column 16, line 6, incorporated herein by reference.

The condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from 2 to 18 moles of ethylene oxide per mole of alcohol. Examples of commercially available nonionic surfactants of this type include Tergitol® 15-S-9 (the condensation product of $C_{11}$–$C_{15}$ linear secondary alcohol with 9 moles ethylene oxide), Tergitol® 24-L-6 NMW (the condensation product of $C_{12}$–$C_{14}$ primary alcohol with 6 moles ethylene oxide with a narrow molecular weight distribution), both marketed by Union Carbide Corporation; Neodol® 45-9 (the condensation product of $C_{14}$–$C_{15}$ linear alcohol with 9 moles of ethylene oxide), Neodol® 23-6.5 (the condensation product of $C_{12}$–$C_{13}$ linear alcohol with 6.5 moles of ethylene oxide), Neodol® 45-7 (the condensation product of $C_{14}$–$C_{15}$ linear alcohol with 7 moles of ethylene oxide), Neodol® 45-4 (the condensation product of $C_{14}$–$C_{15}$ linear alcohol with 4 moles of ethylene oxide), marketed by Shell Chemical Company, and Kyro® EOB (the condensation product of $C_{13}$–$C_{15}$ alcohol with 9 moles ethylene oxide), marketed by The Procter & Gamble Company. Other commercially available nonionic surfactants include Dobanol 91-8® marketed by Shell Chemical Co. and Genapol UD-080® marketed by Hoechst. This category of nonionic surfactant is referred to generally as "alkyl ethoxylates."

The preferred alkylpolyglycosides have the formula $$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n is 2 or 3, preferably 2; t is from 0 to 10, preferably 0; and x is from 1.3 to 10, preferably from 1.3 to 3, most preferably from 1.3 to 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Fatty acid amide surfactants having the formula:

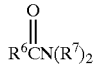

wherein $R^6$ is an alkyl group containing from 7 to 21 (preferably from 9 to 17) carbon atoms and each $R^7$ is selected from the group consisting of hydrogen, $C_1$–$C_4$ alkyl, $C_1$–$C_4$ hydroxyalkyl, and $—(C^2H_4O)_xH$ where x varies from 1 to 3.

Preferred amides are $C_8$–$C_{20}$ ammonia amides, monoethanolamides, diethanolamides, and isopropanolamides.

Preferably the nonionic surfactant, when present in the composition, is present in an effective amount, more preferably from 0.1% to 20%, even more preferably 0.1% to 15%, even more preferably still from 0.5% to 10%, by weight.

The detergent compositions hereof may also contain an effective amount of polyhydroxy fatty acid amide surfactant. By "effective amount" is meant that the formulator of the composition can select an amount of polyhydroxy fatty acid amide to be incorporated into the compositions that will improve the cleaning performance of the detergent composition. In general, for conventional levels, the incorporation of 1%, by weight, polyhydroxy fatty acid amide will enhance cleaning performance.

Where present, the detergent compositions may comprise 1% weight basis, polyhydroxy fatty acid amide surfactant, preferably from 3% to 30%, of the polyhydroxy fatty acid amide. The polyhydroxy fatty acid amide surfactant component comprises compounds of the structural formula:

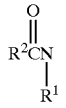

wherein:

$R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly —$CH_2$—$(CHOH)_4$—$CH_2OH$.

R' can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Suitable anionic surfactants for use in the compositions herein include water-soluble salts or acids of the formula $ROSO_3M$ wherein R preferably is a $C_6$–$C_{20}$ linear or branched hydrocarbyl, preferably an alkyl or hydroxyalkyl having a $C_{10}$–$C_{20}$ alkyl component, more preferably a $C_{10}$–$C_{14}$ alkyl or hydroxyalkyl, and M is H or a cation, e.g., an alkali metal cation or ammonium or substituted ammonium, but preferably sodium.

Other suitable anionic surfactants for use herein are water-soluble salts or acids of the formula $RO(A)_mSO_3M$ wherein R is an unsubstituted linear or branched $C_6$–$C_{20}$ alkyl or hydroxyalkyl group having a $C_{10}$–$C_{20}$ alkyl component, preferably a $C_{12}$–$C_{20}$ alkyl or hydroxyalkyl, more preferably $C_{12}$–$C_{14}$ alkyl or hydroxyalkyl, A is an ethoxy or propoxy unit, m is greater than zero, typically between 0.5 and 5, more preferably between 0.5 and 2, and M is H or a cation which can be, for example, a metal cation, ammonium or substituted-ammonium cation. Alkyl ethoxylated sulfates as well as alkyl propoxylated sulfates are contemplated herein. Exemplary surfactants are $C_{10}$–$C_{14}$ alkyl polyethoxylate (1.0) sulfate, $C_{10}$–$C_{14}$ polyethoxylate (1.0) sulfate, $C_{10}$–$C_{14}$ alkyl polyethoxylate (2.25) sulfate, $C_{10}$–$C_{14}$ polyethoxylate (2.25) sulfate, $C_{10}$–$C_{14}$ alkyl polyethoxylate (3.0) sulfate, $C_{10}$–$C_{14}$ polyethoxylate (3.0) sulfate, and $C_{10}$–$C_{14}$ alkyl polyethoxylate (4.0) sulfate, $C_{10}$–$C_{18}$ polyethoxylate (4.0) sulfate. In a preferred embodiment the anionic surfactant is a mixture of alkoxylated, preferably ethoxylated and non-alkoxylated sulfate surfactants. In such a preferred embodiment the preferred average degree of alkoxylation is from 0.4 to 0.8.

Other particularly suitable anionic surfactants for use herein are alkyl sulphonates including water-soluble salts or acids of the formula $RSO_3M$ wherein R is a $C_6$–$C_{20}$ linear or branched, saturated or unsaturated alkyl group, preferably a $C_{10}$–$C_{20}$ alkyl group and more preferably a $C_{10}$–$C_{14}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water- soluble salts or acids of the formula $RSO_3M$ wherein R is an aryl, preferably a benzyl, substituted by a $C_6$–$C_{20}$ linear or branched saturated or unsaturated alkyl group, preferably a $C_{12}$–$C_{16}$ alkyl group and more preferably a $C_{10}$–$C_{14}$ alkyl group, and M is H or a cation, e.g., an alkali metal cation (e.g., sodium, potassium, lithium, calcium, magnesium etc) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

In a further preferred embodiment the carbon chain of the anionic surfactant comprises alkyl, preferably C1-4 alkyl branching units. The average percentage branching of the anionic surfactant is greater than 30%, more preferably from 35% to 80% and most preferably from 40% to 60%. Such average percentage of branching can be achieved by formulating the composition with one or more anionic surfactants all of which are preferably greater than 30% branched, more preferably from 35% to 80% and most preferably from 40% to 60%. Alternatively and more preferably, the composition may comprise a combination of branched anionic surfactant and linear anionic surfactant such that on average the percentage of branching of the total anionic surfactant combination is greater than 30%, more preferably from 35% to 80% and most preferably from 40% to 60%.

The anionic surfactant is preferably present at a level of at least 10%, more preferably from 15% to 40% and most preferably from 20% to 35% by weight of the total composition.

Other additional anionic surfactants useful for detersive purposes can also be used herein. These can include salts (iancluding, for example, sodium, potassium, ammonium, and substituted ammonium salts such as mono-, di- and triethanolamine salts) of soap, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, sulphobetaines, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO$—$M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other particularly suitable anionic surfactants for use herein are alkyl carboxylates and alkyl alkoxycarboxylates having from 4 to 24 carbon atoms in the alkyl chain, preferably from 8 to 18 and more preferably from 8 to 16, wherein the alkoxy is propoxy and/or ethoxy and preferably is ethoxy at an alkoxylation degree of from 0.5 to 20, preferably from 5 to 15. Preferred alkylalkoxycarboxylate for use herein is sodium laureth 11 carboxylate (i.e., $RO(C_2H_4O)_{10}$—$CH_2COONa$, with R=C12–C14) commercially available under the name Akyposoft® 100NV from Kao Chemical Gbmh.

The particular surfactants used can therefore vary widely depending upon the particular end-use envisioned. Suitable additional surfactants are described in detail in the copending provisional patent application of Chandrika Kasturi et al., entitled "Liquid Detergent Compositions Comprising Polymeric Suds Enhancers", having P & G Case No. 6938P, application serial No. 60/066,344, incorporated above.

In a preferred aspect of the present invention, the composition comprises at least 30% surfactant, preferably selected from the group consisting of anionic, foaming nonionic, amphoteric and zwitterionic surfactants.

Polymeric Suds Stabilizer

The compositions of the present invention may optionally contain a polymeric suds stabilizer. These polymeric suds stabilizers provide extended suds volume and suds duration without sacrificing the grease cutting ability of the liquid detergent compositions. These polymeric suds stabilizers are selected from:

i) homopolymers of (N,N-dialkylamino)alkyl acrylate esters having the formula:

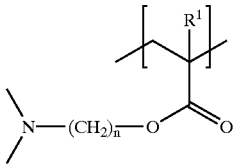

wherein each R is independently hydrogen, $C_1$–$C_8$ alkyl, and mixtures thereof, $R^1$ is hydrogen, $C_1$–$C_6$ alkyl, and mixtures thereof, n is from 2 to 6; and ii) copolymers of (i) and

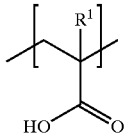

wherein $R^1$ is hydrogen, C1–C6 alkyl, and mixtures thereof, provided that the ratio of (ii) to (i) is from 2 to 1 to 1 to 2; The molecular weight of the polymeric suds boosters, determined via conventional gel permeation chromatography, is from 1,000 to 2,000,000, preferably from 5,000 to 1,000,000, more preferably from 10,000 to 750,000, more preferably from 20,000 to 500,000, even more preferably from 35,000 to 200,000. The polymeric suds stabilizer can optionally be present in the form of a salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely

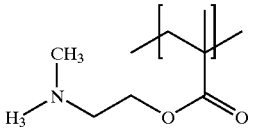

When present in the compositions, the polymeric suds booster may be present in the composition from 0.01% to 15%, preferably from 0.05% to 10%, more preferably from 0.1% to 5%, by weight.

Enzymes

Detergent compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a detergent composition having a cocktail of conventional applicable enzymes like protease, amylase, lipase, cutinase and/or cellulase. Enzymes when present in the compositions, at from 0.0001% to 5% of active enzyme by weight of the detergent composition. Preferred proteolytic enzymes, then, are selected from the group consisting of Alcalase® (Novo Industri A/S), BPN', Protease A and Protease B (Genencor), and mixtures thereof. Protease B is most preferred. Preferred amylase enzymes include TERMAMYL®, DURAMYL® and the amylase enzymes those described in WO 9418314 to Genencor International and WO 9402597 to Novo.

Further non-limiting examples of suitable and preferred enzymes are disclosed in the copending application: "Dishwashing Detergent Compositions Containing Organic Diamines for Improved Grease Cleaning, Sudsing, Low temperature stability and Dissolution", having P & G Case No. 7167P and application serial No. 60/087,693, which is hereby incorporated by reference.

Because hydrogen peroxide and builders such as citric acid and citrates impair the stability of enzymes in LDL compositions, it is desirable to reduce or eliminate the levels of these compounds in compositions which contain enzymes. Hydrogen peroxide is often found as an impurity in surfactants and surfactant pastes. As such, the preferred level of hydrogen peroxide in the amine oxide or surfactant paste of amine oxide is 0–40 ppm, more preferably 0–15 ppm. Amine impurities in amine oxide and betaines, if present, should be minimized to the levels referred above for hydrogen peroxide.

Magnesium Ions

While it is preferred that divalent ions be omitted from LDL compositions prepared according to the present invention, alternate embodiments of the present invention may include magnesium ions.

It is desirable to exclude all divalent ions from the present LDL compositions, because such ions may lead to slower dissolution as well as poor rinsing, and poor low temperature stability properties. Moreover, formulating such divalent ion-containing compositions in alkaline pH matrices may be difficult due to the incompatibility of the divalent ions, particularly magnesium, with hydroxide ions.

Nonetheless, the presence of magnesium ions offers several benefits. Notably, the inclusion of such divalent ions improves the cleaning of greasy soils for various LDL compositions, in particular compositions containing alkyl ethoxy carboxylates and/or polyhydroxy fatty acid amide. This is especially true when the compositions are used in softened water that contains few divalent ions.

But in the present invention, these benefits can be obtained without the inclusion of divalent ions. In particular, improved grease cleaning can be achieved without divalent ions by the inclusion of organic diamines in combination with amphoteric and anionic surfactants in the specific ratios discussed above while enzymes have been shown to improve the skin mildness performance of the present LDL compositions.

If they are to be included in an alternate embodiment of the present LDL compositions, then the magnesium ions are present at an active level of from 0.01% to 1.5%, preferably from 0.015% to 1%, more preferably from 0.025% to 0.5%, by weight. The amount of magnesium ions present in compositions of the invention will be also dependent upon the amount of total surfactant present therein.

Preferably, the magnesium ions are added as a hydroxide, chloride, acetate, sulfate, formate, oxide or nitrate salt to the compositions of the present invention. Because during storage, the stability of these compositions becomes poor due to the formation of hydroxide precipitates in the presence of compositions containing moderate concentrations of hydroxide ions, it may be necessary to add certain chelating agents. Suitable chelating agents are discussed further below and in U.S. Pat. No. 5,739,092, issued Apr. 14, 1998, to Ofosu-asante, incorporated herein by reference.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylene diamine tetracetates, N-hydroxy ethyl ethylene diamine triacetates, nitrilo-tri-acetates, ethylenediamine tetraproprionates, triethylene tetraamine hexacetates, diethylene triamine pentaacetates, and ethanol diglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylene diamine tetrakis (methylene phosphonates) as DEQUEST. Preferred, these amino phosphonates to not contain alkyl or alkenyl groups with more than 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

If utilized, these chelating agents will generally comprise from 0.00015% to 15% by weight of the detergent compositions herein. More preferably, if utilized, the chelating agents will comprise from 0.0003% to 3.0% by weight of such compositions.

Other Ingredients—The detergent compositions will further preferably comprise one or more detersive adjuncts selected from the following: soil release polymers, polymeric dispersants, polysaccharides, abrasives, bactericides and other antimicrobials, tarnish inhibitors, builders, enzymes, dyes, buffers, antifungal or mildew control agents, insect repellents, perfumes, hydrotropes, thickeners, processing aids, suds boosters, brighteners, anti-corrosive aids, stabilizers antioxidants and chelants. A wide variety of other ingredients useful in detergent compositions can be included in the compositions herein, including other active ingredients, carriers, hydrotropes, antioxidants, processing aids, dyes or pigments, solvents for liquid formulations, solid fillers for bar compositions, etc.

If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the detergent compositions of the present invention. They can be any conventional antioxidant used in detergent compositions, such as 2,6-di-tert-butyl-4-methylphenol (BHT), carbamate, ascorbate, thiosulfate, monoethanolamine(MEA), diethanolamine, triethanolamine, etc. It is preferred that the antioxidant, when present, be present in the composition from 0.001% to 5% by weight.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10®, DeGussa) is admixed with a proteolytic enzyme solution containing 3%–5% of $C_{13\text{-}15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned Non-Aqueous Liquid Detergents The manufacture of liquid detergent compositions which comprise a non-aqueous carrier medium can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. No. 4,988,462; U.S. Pat. No. 5,266,233; EP-A-225,654 (Jun. 16, 1987); EP-A-510,762 (Oct. 28, 1992); EP-A-540,089 (May 5, 1993); EP-A-540,090 (May 5, 1993); U.S. Pat. No. 4,615,820; EP-A-565,017 (Oct. 13, 1993); EP-A-030,096 (Jun. 10, 1981), incorporated herein by reference. Such compositions can contain various particulate detersive ingredients stably suspended therein. Such non-aqueous compositions thus comprise a liquid phase and, optionally but preferably, a solid phase, all as described in more detail in the cited references.

Process of Cleaning Hard Surfaces (i.e., Dishware)

The present invention also relates to a process for cleaning hard surfaces (i.e., dishware). The hard surface is contacted with a composition as described above. The composition may be applied to the hard surface neat or in dilute form, such as in water. Thus the hard surface may be cleaned singly by applying the composition to the hard surface and optionally but preferably subsequently rinsing the hard surface, such as with water, before drying. Alternatively, the composition can be mixed with water in a suitable vessel, for example a basin, sink or bowl and thus a number of hard surfaces (i.e., dishes) can be cleaned using the same composition and water (dishwater). In a further alternative process the product can be used in dilute form in a suitable vessel as a soaking medium for, typically extremely dirty, hard surface. As before the hard surface can be optionally, although preferably, rinsed, such as with water, before allowing to dry. Drying make take place passively by allowing for the natural evaporation of water or actively using any suitable drying equipment, for example a cloth or towel.

What is claimed is:

1. A composition suitable for use as a foaming hand dishwashing composition comprising a hydrophobic polymer comprising alkylene oxide moieties selected from the group consisting of butylene oxide, pentylene oxide, hexylene oxide and mixtures thereof, and a solvatrope selected from the group consisting of 1,4 ciclohexana di-methanol; 1,6 hexanediol; 1,7 heptanediol; and mixtures thereof; with the proviso that the composition does not comprise greater than 5% by weight of the composition of a builder.

2. A composition according to claim 1 having viscosity of greater than 300 cps when measured at 20° C.

3. A composition according to claim 2 having viscosity of greater than 500cps when measured at 2° C.

4. A composition according to claim 1 wherein the composition requires no more than 5 rotations to dissolve, when tasted at a concentration of 0.6 ml composition/500 ml water which has a temperature of 35° C. and a hardness of 15 g/gallon and a rotation speed of 22 rpm in a manner according to the cylinder dissolution test method described herein.

5. A composition according to claim 1 comprising greater than 30% surfactant.

6. A composition according to claim 5 wherein the surfactant is selected from anoininc, foaming nonionic surfactants, amphoteric surfactants, zwitterionic surfactants and mixtures thereof.

7. A composition according to claim 1 wherein the molecular weight of the hydrophobic polymer is greater than 500, but less than 5000.

8. A composition according to claim 1 wherein the hydrophobic polymer is further comprises alkylene oxide moieties selected from the group consisting of: propylene oxide, ethylene oxide, and mixtures thereof.

9. A composition according to claim 1 wherein the hydrophobic polymer comprises block and/or random alkylene oxide moieties.

10. A composition according to claim 1 wherein the hydrophobic polymer is made by reacting alkylene oxide moieties with an alcohol.

11. A composition according to claim 1 additionally comprising a hydrotrope selected from the group consisting of cumene sulphonic acid, xylene sulphonic acid, toluene sulphonic acid, naphthalene sulphonic acid, sodium, potassium, calcium, ammonium salts thereof and mixtures thereof.

12. A composition according to claim 1 additionally comprising a viscosity modifier selected from the group consisting of alcohols, ethers and mixtures thereof.

13. A composition according to claim 12 wherein the viscosity modifier is selected from the group consisting of ethanol, glycerol, propylene glycol, polyethylene glycol and mixtures thereof.

14. A composition according to claim 1 additionally comprising an organic diamine in which pK1 and pK2 of the diamine are in the range of 8 to 11.5.

15. A composition according to claim 1 additionally comprising a homopolymer or copolymer comprising a monomer unit having the formula:

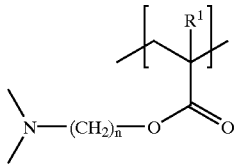

wherein each R is independently hydrogen, $C_1$–$C_8$ alkyl, and mixtures thereof, $R^1$ is hydrogen, $C_1$–$C_6$ alkyl, and mixtures thereof, n is from 2 to 6.

16. A composition according to claim 1 additionally comprising an enzyme.

17. A process of treating a hard surface in used of treatment comprising contacting the hard surface in used of treatment with the composition according to claim 1 and optionally rinsing the hard surface with water such that the hard surface is treated.

18. A process of treating a hard surface in used of treatment comprising contacting the hard surface in need of treatment with water comprising the composition according to claim 1 and optionally rinsing the hard surface with water such that the hard surface is treated.

19. A method for improving the solubility of a hand dishwashing composition the, method comprising adding the composition according to claim 1 to the hand dishwashing composition.

* * * * *

UNITED STATES PATENT AND TRADEMARK OFFICE

CERTIFICATE OF CORRECTION

PATENT NO. : 6,790,818 B2 
APPLICATION NO. : 10/102125
DATED : September 14, 2004
INVENTOR(S) : Brian Mruk It is certified that error appears in the above-identified patent and that said Letters Patent is hereby corrected as shown below:

Column 21,
Line 25, delete "tasted" and insert -- tested --.

Column 22,
Lines 21-28, delete

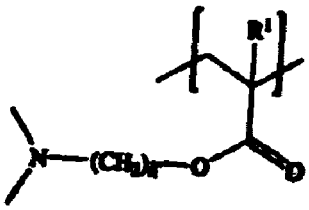

and insert

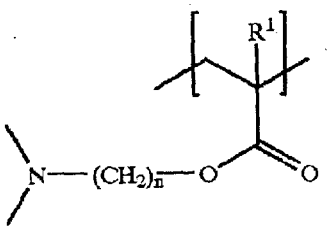

Lines 33, 34 and 38, delete "used" and insert -- need --.

Signed and Sealed this

Eleventh Day of July, 2006

JON W. DUDAS
*Director of the United States Patent and Trademark Office*